US005143560A

United States Patent [19]

Doser

[11] Patent Number: 5,143,560

[45] Date of Patent: Sep. 1, 1992

[54] METHOD FOR FORMING FE-B-R-T ALLOY POWDER BY HYDROGEN DECREPITATION OF DIE-UPSET BILLETS

[75] Inventor: Manfred Doser, Edmore, Mich.

[73] Assignee: Hitachi Metals, Inc., Ltd., Purchase, N.Y.

[21] Appl. No.: 512,643

[22] Filed: Apr. 20, 1990

[51] Int. Cl.[5] ..... H01F 1/02

[52] U.S. Cl. ..... 148/101; 148/103; 148/104; 148/105; 419/12; 419/33; 419/38; 241/18; 241/24; 241/29

[58] Field of Search ..... 148/101, 103, 104, 102, 148/105; 419/12, 33, 38; 241/18, 24, 29

[56] References Cited

U.S. PATENT DOCUMENTS

| | | | |
|---|---|---|---|
| 4,572,750 | 2/1986 | Masumoto et al. | 420/441 |
| 4,760,966 | 8/1988 | Finnegan et al. | 241/1 |
| 4,792,367 | 12/1988 | Lee | 148/104 |
| 4,802,931 | 2/1989 | Croat | 148/302 |
| 4,834,812 | 5/1989 | Ghandehari | 148/101 |
| 4,853,045 | 8/1989 | Rozendaal | 148/103 |

FOREIGN PATENT DOCUMENTS

| | | | |
|---|---|---|---|
| 258609 | 3/1988 | European Pat. Off. . | |
| 306928 | 3/1989 | European Pat. Off. . | |
| 60-063304 | 4/1985 | Japan . | |
| 60-119701 | 6/1985 | Japan . | |
| 62-132304 | 6/1987 | Japan | 148/104 |
| 63-90104 | 4/1988 | Japan | 148/104 |
| 1-99201 | 4/1989 | Japan | 148/101 |

OTHER PUBLICATIONS

McGuiness et al, Hydrogenation, Disproportionation and Desorption (HDD): an Effective Processing Route for Nd—Fe—B Type Magnets, Journal of the Less Common Metals, 158 (1990) 359–365.

Hydrogen Absorption and Desorption in $Nd_2Fe_{14}B$, J. M. Cadogan et al., Appl. Phys. Lett. 48(6), 442–442 (1986).

The Hydrogen Decrepitation of an $Nd_{15}Fe_{77}B_8$ Magnetic Alloy, I. R. Harris et al., Journ. Less-Common Metals 106, L1–L4 (1985).

The Hydrogen Atmosphere Sintering of Cobalt-Samarium Magnets, F. G. Jones et al., IEEE Trans. Magn. *MAG-13*, 1320–22 (1977).

Hydrogen Absorption of Rare Earth (3d) Transition Intermetallic Compounds, Van Mal et al., Journ. Less--Common Metals 49, 473–75 (1976).

*Primary Examiner*—John P. Sheehan

*Attorney, Agent, or Firm*—Gifford, Groh, Sprinkle, Patmore & Anderson

[57] ABSTRACT

A method for the high volume manufacture of Fe-B-R-T alloy powders without sacrificing the resultant magnetic properties (such as intrinsic magnetic coercivity) of the alloy involves hydrogen decrepitation of vacuum cast or die-upset billets of the alloy. Hydriding is carried out at a partial pressure of hydrogen of between 250 and 760 mm Hg at 100° to 500° C. for 30 minutes to 6 hours or longer, depending upon load size. Dehydriding occurs in a vacuum below $10^{-2}$ mm Hg or in an inert atmosphere possessing a partial pressure of hydrogen below $10^{-2}$ mm Hg. The alloy powder is preferably incorporated in matrix or composite magnets by the addition of a binder prior to pressing and orienting. The binder may set during pressing in a hot die, or by heating after pressing in a cold die.

30 Claims, No Drawings

METHOD FOR FORMING FE-B-R-T ALLOY POWDER BY HYDROGEN DECREPITATION OF DIE-UPSET BILLETS

BACKGROUND OF THE INVENTION

I. Field of the Invention

The present invention is directed to methods for forming permanent magnetic bodies, and in particular, bodies incorporating Fe-B-R-T alloy powders.

II. Description of the Prior Art

Fe-B-R-T alloys constitute a known class of alloys formed from varying proportions of iron (Fe), boron (B), one or more rare earth elements (R), and one or more transition elements or related elements (T). With respect to this class of alloys, "rare earth elements" is recognized to include yttrium, scandium, lanthanum, and the rare earths in the lanthanoid series, as well as useful or potentially useful mixtures of them, such as didymium and misch metal. "Transition elements or related elements" is recognized to include not only the transition elements (the metals of families IB and IIIB through VIIIB, inclusive), but also certain nontransition elements located in the periodic table near the light transition elements, which are useful or potentially useful in replacement of or in combination with transition elements in Fe-B-R-T alloys. These related elements include (but are not limited to) zinc, gallium, aluminum, and silicon.

When appropriately prepared, Fe-B-R-T alloys possess permanent magnetic properties which have been found to be useful for a variety of purposes. Most notably, when pulverized to acceptable powder size, anisotropic Fe-B-R-T alloy powders are particularly useful in the formation of composite magnets of various unique and complicated forms. In one method for the manufacture of such composite magnets, the alloy powders are mixed with an organic polymer or plastic (either thermosetting or thermoplastic, commonly epoxy resin) or metal solder, and thereafter aligned and pressed to form a matrix magnet. In an alternative method (impregnation), the alloy powders are first pressed into a desired form and sintered, and a cureable resin is then introduced under high pressure into the spaces or interstices between the sintered powder particles.

Fe-B-R-T alloys can be manufactured in gross by several known techniques, for example, by the vacuum casting or die-upset billet techniques. However, the use of such alloys has in practice been subject to the disadvantage that cast or die-upset billets of Fe-B-R-T alloys are extremely difficult to mechanically pulverize. When mechanically crushed with devices such as disk mills or hammer mills, these alloys are found to be very hard to cleave along the "a" axis or grain boundaries. Crushing yields slivers of alloy material that may be 100 micrometers in thickness yet one-quarter inch in diameter. Conventional mechanical crushing processors or devices typically yield only one to two pounds of powdered alloy per hour of treatment for small units. The effort and cost of powdering the alloy significantly increases the cost of manufacturing the matrix or composite magnets desired.

While other methods of pulverizing iron alloys are known, the application of such methods to Fe-B-R-T alloys appears to encounter other drawbacks. For example, it has been possible to decrepitate and pulverize Fe-B-R and R-T (for example, samarium-cobalt) alloys by sequential hydriding. Such decrepitation has generally been carried out at hydrogen pressures of either a few tenths of an atmosphere or greater than one atmosphere, most often significantly greater than one atmosphere. Previous attempts to employ such methods to pulverize Fe-B-R-T alloys have encountered the disadvantage that the treated alloys have suffered an unacceptable decrease in their room temperature intrinsic magnetic coercivity ($H_{ci}$) after saturation magnetization. Applicant does not believe any of such previous attempts constitute prior art with respect to the present invention; in any event, however, composite or matrix magnets incorporating Fe-B-R-T alloy powders formed by such prior attempts have not possessed magnetic properties adequate for their intended use.

Fe-B-R-T powders have also been formed by melt-quenching of the alloy. The melt-quenching process, however, forms isotropic powders, rather than anisotropic powders as achieved with the die-upset process. Composite magnets manufactured from melt-quench powders therefore have magnetic properties inferior to those manufactured from die-upset alloy powders.

SUMMARY OF THE PRESENT INVENTION

Applicant has discovered that the key to maintaining an acceptably high intrinsic magnetic coercivity in an Fe-B-R-T alloy powder formed by hydrogen decrepitation is to outgas the alloy (that is to, remove the hydrogen from the hydrided alloy by heating it an atmosphere lacking hydrogen, or in a vacuum) at a temperature high enough and for a time adequate to remove substantially all of the hydrogen present in the alloy as the hydride, yet a temperature low enough and for a time short enough and prevent the growth of large crystals in the resultant powders. It is believed that excessive retention of hydrogen in the powders (as the hydride) has been the cause of the decrease in coercivity encountered in prior attempts to treat Fe-B-R-T alloys by hydrogen decrepitation. The method of the present invention avoids this decrease by requiring a dehydriding temperature adequate to remove the excess hydrogen, typically employing a temperature above about 500° C.

More particularly, the method of the present invention preferably first comprises hydriding a previously formed billet (preferably a vacuum cast, die-upset billet, although vacuum cast material is itself useful) of Fe-B-R-T alloy at 100° to 500° C. in a hydrogen atmosphere at about −10 inches of Hg for about one half hour to one hour. The length of time for hydriding will depend upon the size of the billet or the total load in the treatment furnace, but in any event is selected to be adequate to yield substantial hydriding of the alloy. The alloy is then dehydrided, preferably by heating in a vacuum on the order of $2\times10^{-4}$ mm Hg, typically for one half hour to one hour at a temperature between 500° and 800° C. The alloy can also be dehydrided by heating in a flow of inert gases lacking hydrogen Preferably, the dehydriding step can be carried out by a program of linearly increasing the alloy temperature from the hydriding temperature to a final outgassing temperature (for example, 750° C.) at which the alloy is held until the vacuum on it reaches about $10^{-3}$ Hg.

Once the alloy is dehydrided, it is cooled in a vacuum or an inert atmosphere to ambient temperature. The desired particle size is then screened directly from the dehydrided alloy, and the alloy powder used to form a composite magnet. Such magnets are typically pressed in the range of 15 to 50 tons per square inch.

The dehydriding process of the present invention typically provides a range of powder sizes, and it has been discovered that the particles of powder which might be initially unacceptably large can unexpectedly be readily milled with a disk mill or hammer mill, without the difficulty and cleaving encountered in the untreated alloy. The present invention advantageously provides an output rate of powder about one hundred times that of prior mechanical methods for grinding the untreated alloy, typically about one hundred to two hundred pounds of powder per hour. Most importantly, however, this hundred-fold increase in output is achieved without sacrificing the coercivity of the composite magnets formed from the powder. The matrix or composite magnets formed from the Fe-B-R-T alloy decrepitated in accordance with the present invention possesses a coercivity which is typically about the same as or slightly better than that enjoyed by composite magnets made from conventionally milled alloy powders. This dramatic increase in processing efficiency while the magnetic properties of the alloy are maintained is expected to be the key to making such composite magnets commercially competitive.

DETAILED DESCRIPTION OF THE PREFERRED EMBODIMENT OF THE PRESENT INVENTION

The present invention will now be described with reference to a particularly preferred Fe-B-R-T alloy; however, the particular alloy composition disclosed is merely a non-limiting example of the range of alloys which can be successfully decrepitated by the method of the present invention, R and T having the broad meanings given above.

EXAMPLE 1

Starting billets of an Fe-B-R-T alloy were produced in accordance with the teachings of U.S. Pat. No. 4,496,395 (withdrawn), U.S. Pat. No. 4,802,931, U.S. Pat. No. 4,792,367, and U.S. Pat. No. 4,844,754, all of which are incorporated by reference herein. The billets contained 2.3% by weight cobalt, 0.8 to 1.1% by weight boron, 30.8% plus or minus 0.5% by weight neodymium, and the balance iron. The billets also contained traces of other rare earth elements and contaminants in an amount believed to be too small to significantly effect the magnetic properties of the alloy. Such contamination is virtually always encountered in alloys containing one or more rare earth elements. The cost and difficulty associated with isolation of the chemically similar rare earths from one another makes it impractical to reduce trace contaminants below a level at which they do not appreciably detract from the properties of the magnets containing them.

Sample 1 was prepared from about 100 grams of this die-upset billet material, and was hydrided at less than one atmosphere hydrogen pressure in a furnace. The temperature of the furnace was raised from 25° C. to 400° C. while the hydrogen atmosphere was maintained. Once a temperature of 400° C. was obtained, the hydrogen atmosphere was removed by vacuum, and the material outgassed at 500° C. for thirty minutes while vacuum was maintained. The material was then quenched in helium gas. The resulting material was then pulverized to a size generally larger than 325 mesh but smaller than 25 mesh. Four percent by weight epoxy binder was blended with this screened powder, and the resulting mixture aligned in a magnetic field of greater than 15kOe and pressed at thirty tons per inch. The epoxy was then cured.

Sample 2 was prepared in essentially the same fashion as Sample 1, except that outgassing was carried out by ramping the temperature under vacuum from 400° C. to 700° C. at 4.1° C. per minute. The material was promptly quenched after the 700° C. temperature was reached.

Sample 3 was prepared according to the same technique as was Sample 2, except that the top outgasing temperature was 800° C.

Sample 4 was prepared from the same die-upset material as Samples 1 through 3, but was not hydrided and dehydrided. Instead, the material was mechanically pulverized, and then mixed with the epoxy and bonded in the same manner.

Table 1 discloses the magnetic properties of bonded magnets incorporating alloy powders prepared from the four samples, Br indicating the magnetic remanence in gauss, $H_{ci}$ the intrinsic coercivity in oersteds, and $BH_m$ the energy product in mega-gauss oersteds:

TABLE 1

Dependence of Magnetic Properties upon Method of Preparing Alloy Powder (Bonded Magnets)

| Sample | Density (g/cc) | $B_r$ (G) | $H_{ci}$ (Oe) | $BH_m$ (MG.Oe) |
|---|---|---|---|---|
| 1 | 5.45 | 5300 | 2400 | 2.2 |
| 2 | 5.10 | 6000 | 4100 | 4.4 |
| 3 | 5.82 | 7200 | 12500 | 11.3 |
| 4 | 5.85 | 7450 | 12600 | 11.7 |

The bonded magnets incorporating the powder of Sample 3 clearly possessed magnetic properties comparing quite favorably to the magnetic properties of bonded magnets incorporating the conventially pulverized alloy powders of Sample 4. The magnetic properties of magnets incorporating the alloy powder of Sample 3 were substantially better than the magnetic properties achieved by bonded magnets incorporating the powders of Samples 1 and 2. It appears clear from these samples that outgassing adequate to remove substantially all of the hydrogen from the hydrided alloy is critical to recovering the magnetic properties of the conventionally machined powder.

EXAMPLE 2

Because an alloy powder size below 325 mesh oxidizes fairly easily, samples of hydrided material were prepared at various hydriding temperatures in order to determine an optimum hydriding temperature. In order to provide an ultimate alloy powder of a size generally larger than 325 mesh, it would be preferred that a hydriding temperature be selected such that the hydrided material mesh size possessed a substantial fraction larger than 25 mesh and a moderate proportion between 325 and 25 mesh size. This permits an alloy powder size to be achieved after dehydriding falling generally between 25 and 325 mesh size.

Samples identical in composition to Samples 1 through 4 were subjected to the different hydriding temperatures shown in Table 2. In the treatment of each sample, the hydrogen was introduced to the sample when the sample had obtained the indicated hydriding temperature, and the hydriding temperature was held for 45 minutes in a hydrogen atmosphere below one atmosphere pressure, before being quenched to room temperature by an inert gas. No outgassing was done on these samples.

TABLE 2

Dependence of Particle Size of Hydrided Alloy Upon Hydriding Temperature (No Outgassing)

| Hydriding Temperature (°C.) | Parts by Weight of Each Sample | | |
|---|---|---|---|
| | Larger than 25 mesh | Between 325 and 25 mesh | Smaller than 325 mesh |
| 300 | 17.3 | 65.0 | 1.4 |
| 400 | 50.6 | 19.7 | 0.3 |
| 500 | 81.2 | 5.3 | less than 0.1 |
| RT to greater than 500 (10° C./min ramp) | 60.8 | 95.8 | 1.9 |

It can be seen from the data in Table 2 that the particle size generally becomes larger as the hydriding temperature increases. Longer times at the higher temperatures would be necessary to achieve the same particle size distribution as is achieved at lower hydriding temperatures. It appears from this data that 400° C. is a favorable hydriding temperature for obtaining a hydrided alloy powder useful for providing an acceptable range of powder size upon dehydriding.

EXAMPLE 3

The magnetic properties of bonded magnets incorporating the alloy powder of the present invention vary in dependence upon the outgassing temperature and the outgassing time. A number of 100 gram samples from a single die-upset billet of the same composition as Samples 1 through 4 were hydrided at 400° C. for thirty minutes, and then subjected to vacuum and raised to a variety of outgassing temperatures as identified in Table 3. The samples were maintained at the particular outgassing temperatures for thirty minutes or one hour, as indicated, and thereafter formed into bonded magnets in the same manner as Samples 1 through 4. Table 3 shows the dependence of the magnetic properties of the resultant bonded magnets upon outgassing temperature:

TABLE 3

Dependence of Magnetic Properties Upon Outgassing Temperature (Bonded Magnets)

| Outgassing Temperature (°C.) | Density (g/cc) | $B_r$ (G) | $H_{ci}$ (Oe) | $BH_m$ (MG.Oe) | Outgassing Time (min) |
|---|---|---|---|---|---|
| 500 | 5.95 | 7700 | 7800 | 11.0 | 30 |
| 600 | 5.95 | 7950 | 14400 | 14.0 | 30 |
| 650 | 6.00 | 7500 | 14800 | 12.5 | 30 |
| 700 | 5.95 | 7500 | 14200 | 12.5 | 30 |
| 725 | 5.95 | 7600 | 14500 | 13.0 | 30 |
| 750 | 5.95 | 7750 | 13100 | 13.2 | 30 |
| 800 | 5.95 | 7000 | 10600 | 9.2 | 30 |
| 600 | 5.95 | 7950 | 15100 | 14.0 | 60 |
| 650 | 6.05 | 7300 | 15600 | 13.0 | 60 |
| 700 | 5.90 | 7200 | 14400 | 12.5 | 60 |

It is evident from the data in Table 3 that the magnetic properties of the bonded magnets suffered a drop in value when the alloy powder was outgassed either above 750° C. or below 500° C. The sizes of the alloy grains after bonding ranged near 2000 angstroms over most of the range of outgassing temperatures but rose dramatically to 8000 angstroms at an outgassing temperature of 800° C. This increase in grain size caused the magnetic intrinsic coercivity to drop significantly at the highest outgassing temperature.

The drop in magnetic properties observed at an outgassing temperature of 500° C. appeared to arise from the hydrogen content of the various samples. As shown in Table 4, at 500° C. the hydrogen was not completely removed from the samples during the outgassing time used, or at least not removed to the degree adequate to allow the alloy to recover the magnetic properties it had before treatment.

TABLE 4

Dependence of Hydrogen and Oxygen Content Upon Outgassing Temperature

| Outgassing Temperature (°C.) | Outgassing Time (min) | % By Weight $H_2$ | % By Weight $O_2$ |
|---|---|---|---|
| 500 | 30 | 0.026 | 0.115 |
| 600 | 30 | 0.014 | 0.086 |
| 650 | 30 | 0.0018 | 0.10 |
| 700 | 30 | 0.0015 | 0.097 |
| 800 | 30 | 0.0020 | 0.16 |
| 600 | 60 | 0.0021 | |
| 650 | 60 | 0.0024 | |
| Control (no hydriding) | 0 | 0.0020 | 0.10 |

The control sample of Table 4 was one in which there was no hydriding, but rather was simply a sample of the initial die billet material employed for making the other samples.

The magnetic properties shown in Table 3 and the levels of hydrogen shown in Table 4 demonstrate that it is possible to remove substantially all of the hydrogen from the treated alloy at a significantly lower temperature than that suggested by prior publications for alloys such as Fe-B-R and R-T. This difference in useful temperature may arise from the fact that rapid quenched materials have significantly finer grain and possess less neodymium-rich phases than vacuum cast materials, such as some Fe-Nd-B alloys employed in the prior art.

EXAMPLE 4

Hydriding temperature also appeared to have some effect upon outgassing effectiveness and the concentration of hydrogen and oxygen in the resulting alloy powders. Various samples from a single billet of the same composition as Samples 1 through 4 were exposed to less one atmosphere hydrogen pressure for 30 minutes at the hydriding temperatures indicated in Table 5, and then either outgassed or not, as indicated. When outgassed, the outgassing occurred at 650° C. for 1 hour in a vacuum.

TABLE 5

Dependence of Hydrogen and Oxygen Content Upon Hydriding Temperature

| Hydriding Temperature (C.°) | Outgassing (@ 650° C. for 1 hour)? | % By Weight $H_2$ | % By Weight $O_2$ |
|---|---|---|---|
| 200 | Yes | 0.0077 | 0.13 |
| 300 | Yes | 0.0020 | 0.11 |
| 400 | Yes | 0.0024 | 0.11 |
| 200 | No | 0.21 | 0.14 |
| 300 | No | 0.19 | 0.105 |
| 400 | No | 0.13 | 0.08 |
| Control (no hydriding) | No | 0.0020 | 0.10 |

The data of Table 5 show that it appeared to be more difficult to remove hydrogen from the hydrided alloy when lower hydriding temperatures were used. A sample of the same material was also hydrided at 100° C. for 30 minutes under similar conditions, but no decrepitation was observed. That same sample, however, was subsequently hydrided under the same conditions and at 100° C. for an additional 4½ hours, at which time decrepitation of the sample did take place. These data indicate that, at the low hydrogen pressures employed in the present invention, hydriding is more difficult to initiate at lower temperatures.

EXAMPLE 5

Since Example 4 suggests an advantageous outgassing time of 1 hour at 650° C., it would be desirable to select a hydriding temperature which yields the optimum magnetic properties of bonded magnets incorporating the final alloy powder obtained. Table 6 discloses the hydriding temperature and hydriding time for four Samples F53 through F56, as well as two control Samples F58 and F61 which were not subjected to hydriding. Sample F61 was aged at 650° C. for 1 hour to determine whether it was merely the treatment temperature that gave rise to the improved intrinsic magnetic coercivity enjoyed by the alloys treated in accordance with the present invention. The alloy composition and method of bonding were the same as in Samples 1 through 4.

TABLE 6

Dependence of Magnetic Properties Upon Treatment Parameters (Bonded Magnets)

| Sample | Density (g/cc) | Hydriding Temperature (°C.) | Hydriding Time (min) |
|---|---|---|---|
| F53 | 5.92 | 400 | 30 |
| F54 | 5.87 | 300 | 30 |
| F55 | 5.91 | 200 | 30 |
| F56 | 5.89 | 100 | 300 |
| Controls (not hydrided) | | | |
| F58 | 5.97 | None | None |
| F61 | 5.95 | None | None |

| Sample | $B_r$ (G) | $H_{ci}$ (Oe) | $BH_m$ (MG.Oe) | $H_k$ (Oe) |
|---|---|---|---|---|
| F53 | 7500 | 13000 | 12.4 | 5100 |
| F54 | 7450 | 13400 | 12.2 | 4800 |
| F55 | 7500 | 13000 | 12.0 | 4300 |
| F56 | 7600 | 13400 | 12.9 | 5500 |
| Controls (not hydrided) | | | | |
| F58 | 8000 | 11450 | 13.9 | 4800 |
| F61 | 8100 | 12300 | 14.4 | 5050 |

It appears from Table 6 that hydrogen decrepitation of the alloy powder can under some circumstances yield coercivity superior to that of untreated (that is, mechanically pulverized) controls. However, the magnetic remanence of all of Samples F53 through F56 were lower than the nonhydrided samples. It was believed that this difference was due to a difference in particle size distribution in the alloys making up the bonded magnets. Bonded magnets incorporating various ranges of particle size were prepared and tested in Example 6 in order to determine the accuracy of this belief.

EXAMPLE 6

Bonded magnets were formed from alloy particles of various ranges of mesh sizes of the same composition as Samples 1 through 4, prepared in generally the same manner. The selected ranges were between 325 and 170 mesh, between 170 mesh and 120 mesh, between 120 mesh and 60 mesh, and between 60 mesh and 40 mesh. A bonded magnet was also prepared as a control from mechanically pulverized, nonhydrided Fe-B-R-T alloy, from particles in the mesh range of 325 to 170. The treated alloy particles were outgassed at 800° C. for a time adequate to remove substantially all of the hydrogen.

TABLE 7

Dependence of Magnetic Properties Upon Particle Size (Bonded Magnets)

| Mesh | Density (g/cc) | $B_r$ (G) | $H_{ci}$ (Oe) | $BH_m$ (MG.Oe) | $H_k$ (Oe) |
|---|---|---|---|---|---|
| 325 to 170 | 5.60 | 6800 | 12500 | 10.2 | 4200 |
| 170 to 120 | 5.68 | 6900 | 12700 | 10.3 | 4200 |
| 120 to 60 | 5.80 | 7250 | 12750 | 11.6 | 4900 |
| 60 to 40 | 5.90 | 7450 | 12700 | 12.2 | 4800 |
| Control (not hydrided) | | | | | |
| 325 to 170 | 5.55 | 7150 | 12500 | 11.0 | 4200 |

These data suggest that the magnetic properties of the resulting bonded magnets depend in part upon the particle size employed to form the magnet, and that bonded magnets incorporating coarser decrepitated powders can have magnetic properties comparable to bonded magnets incorporating finer, mechanically pulverized alloy powders.

Additional experiments with larger sample sizes have shown that the hydriding time must be increased with larger loads in order to achieve full decrepitation after dehydriding. For example, while a 100 gram sample can be substantially fully hydrided in 20 to 30 minutes at 400° C., a one kilogram sample will typically take 45 minutes at 400° C. for complete decrepitation upon dehydriding.

While all of the above Examples have been carried out with an Fe-B-R-T alloy of the composition described in Example 1, the utility of the present invention is not limited to that particular alloy or to the particular elemental proportions disclosed. For example, results comparable to the above Examples have been obtained with Fe-B-R-T alloys containing 15% cobalt, or 0.6% gallium and 15% cobalt, as well as up to 2.5% boron. Indeed, the process of the present invention is expected to be useful with any Fe-B-R-T alloy which is subject to hydriding and dehydriding.

Of course, the hydriding and outgassing temperatures and times can be varied from those shown in the Examples in order to optimally adapt the method of the present invention to the particular alloy treated. Advantageously, for example, the partial pressure of the hydrogen atmosphere can be anywhere between 250 mm Hg and 760 mm Hg. The programmed rise in outgassing temperature can range from 2° C. per minute to 30° C. per minute. When outgassing is performed under vacuum, the vacuum can range between $10^{-2}$ mm Hg and $10^{-4}$ mm Hg or lower.

The method of the present invention is expected to be useful with any transition or related element T and any rare earth or similar element R which, when alloyed with iron and boron, yield an alloy having acceptable magnetic properties. Having described my invention, however, many modifications to it and equivalents of it will become apparent to those skilled the art to which it pertains, without deviation from the spirit of the present invention, as defined by scope of the appended claims.

I claim:

1. A method for treating an Fe-B-R-T permanent magnet alloy, in which R is at least one of yttrium, scandium, lanthanum, the rare earth elements in the lanthanoid series, or mixture thereof, and in which T is at least one transition element at least one element selected from the group consisting of gallium, silicon, aluminum, zinc, or mixtures thereof, said method comprising the sequential steps of:

subjecting the Fe-B-R-T alloy to a die upsetting operation to form a die-upset alloy;

heating said die-upset Fe-B-R-T alloy in a hydrogen-containing atmosphere at a pressure between 250 and 760 mm Hg at a first temperature and for a time sufficient to bring about substantially hydriding of said alloy, said first temperature being up to about 500° C; and heating said hydrided Fe-B-R-T ally by linearly increasing the temperature of said alloy from said first temperature to a second temperature of about 400° to 650° C. in a vacuum of no more than $10^{-2}$ mm Hg or in an inert atmosphere having a partial pressure of hydrogen of no more than $10^{-2}$ mm Hg, for a time sufficient to bring about substantially complete dehydriding of said alloy;

said time, said first temperature and said second temperature and pressure of hydriding and dehydriding being selected together so as to yield a resulting alloy powder or readily friable Fe-B-R-T alloy material having good intrinsic magnet coercivity, while avoiding the growth of large crystals in said resulting alloy.

2. The method according to claim 1, wherein said transition element is cobalt.

3. The method according to claim 2, wherein said alloy includes about 2.3% by weight cobalt.

4. The method according to claim 2, wherein said alloy includes 15% by weight cobalt.

5. The method according to claim 1, wherein R is neodymium.

6. The method according to claim 5, wherein said alloy includes about 30.3 to about 31.3% by weight neodymium.

7. The method according to claim 1, wherein said alloy includes about 0.8 to about 2.5% by weight boron.

8. The method according to claim 1, wherein said alloy includes about 0.1 to about 2% by weight gallium.

9. The method according to claim 1, wherein said alloy includes about 0.1 to about 1% by weight aluminum.

10. The method according to claim 1, wherein said alloy includes about 0.1 to about 0.5% by weight silicon.

11. The method according to claim 1, wherein said hydrogen-containing atmosphere is essentially molecular hydrogen.

12. The method according to claim 1, wherein the partial pressure of hydrogen in said hydrogen-containing atmosphere is about 500 mm Hg.

13. The method according to claim 1, wherein said hydriding temperature is between about 100° and 500° C.

14. The method according to claim 12, wherein said hydriding temperature is about 400° C.

15. The method according to claim 1, wherein said dehydriding temperature is between about 400° and 800° C.

16. The method according to claim 14, wherein said dehydriding temperature is about 650° C.

17. The method according to claim 1, comprising the intermediate step of removing said hydrogen-containing atmosphere and increasing the temperature of said alloy from said hydriding temperature to said dehydriding temperature.

18. The method according to claim 17, wherein said alloy is maintained at said dehydriding temperature after said dehydriding temperature is achieved.

19. The method according to claim 17, wherein the temperature of said alloy is ramped from said hydriding temperature up to said dehydriding temperature at a rate of about 2° to 30° C. per minute.

20. The method according to claim 19, wherein said dehydriding temperature is between 700° and 800° C.

21. The method according to claim 1, wherein said resulting alloy material is thereafter mechanically reduced to a powder.

22. The method according to claim 1, wherein said resulting alloy is formed into a magnet by sintering and aligning said alloy in an orienting magnetic field.

23. The method according to claim 1, wherein said resulting alloy is blended with a binder, aligned in an oriented magnetic field, and pressed.

24. The method according to claim 22, wherein said binder is epoxy.

25. The method according to claim 23, wherein said alloy is mixed with about 4% by weight of said epoxy.

26. The method according to claim 23, wherein said oriented magnetic field is greater than 15 kOe.

27. The method according to claim 23, wherein the pressure applied is about 15 to about 50 tons per inch.

28. The method according to claim 23, wherein the pressure applied is about 30 tons per inch.

29. The method according to claim 23, wherein said binder is an organic polymer, or a metal solder.

30. The method according to claim 1, wherein said resulting alloy is pressed and sintered, and wherein a cureable binder is thereafter introduced under high pressure into the interstices between the sintered alloy particles.

* * * * *

UNITED STATES PATENT AND TRADEMARK OFFICE

CERTIFICATE OF CORRECTION

PATENT NO. : 5,143,560

DATED : Sep. 1, 1992

INVENTOR(S) : Manfred Doser

It is certified that error appears in the above-identified patent and that said Letters Patent is hereby corrected as shown below:

Column 2, line 59, "hydrogen Preferably" should read --hydrogen. Preferably--.

Column 4, line 21, "Br" should read --$B_r$--.

Column 5, line 8, "Parts by Weight of Each Sample" should read --Parts by Weight of Each Sample in Screen Fraction (Mesh)--.

Signed and Sealed this

Ninth Day of November, 1993

*Attest:*

*Attesting Officer*

BRUCE LEHMAN

*Commissioner of Patents and Trademarks*